US005124752A

United States Patent [19]

Kanno et al.

[11] Patent Number: 5,124,752

[45] Date of Patent: Jun. 23, 1992

[54] DEVELOPING APPARATUS

[75] Inventors: Makoto Kanno; Yoshio Shinna; Akihiko Kato; Toru Isosu; Toru Ishikawa, all of Kanagawa, Japan

[73] Assignee: Fuji Xerox Co., Ltd., Tokyo, Japan

[21] Appl. No.: 670,754

[22] Filed: Mar. 15, 1991

[30] Foreign Application Priority Data

Mar. 19, 1990 [JP] Japan ..... 2-67327

[51] Int. Cl.[5] ..... G03G 15/09

[52] U.S. Cl. ..... 355/253; 118/688

[58] Field of Search ..... 355/245, 246, 253, 260, 355/208; 118/656, 651, 661, 688, 690, 691

[56] References Cited

U.S. PATENT DOCUMENTS

| | | | |
|---|---|---|---|
| 4,682,874 | 7/1987 | Fantuzzo | 355/246 X |
| 4,955,317 | 9/1990 | Kinoshita | 355/246 X |
| 4,956,669 | 9/1990 | Nakamura | 355/208 |
| 4,959,692 | 9/1990 | Hayashi et al. | 355/253 |
| 4,987,452 | 1/1991 | Nakagawa et al. | 355/245 |
| 4,999,676 | 3/1991 | Mouri | 355/246 |
| 5,036,364 | 7/1991 | Murasawa | 355/253 X |

*Primary Examiner*—R. L. Moses
*Assistant Examiner*—Sandra L. Brasé
*Attorney, Agent, or Firm*—Finnegan, Henderson, Farabow, Garrett and Dunner

[57] ABSTRACT

A developing apparatus comprises a developing roll for carrying single-component toner to a developing area facing an electrostatic latent image carrier; a toner agitation chamber provided along an axis of the developing roll; a toner carry-in path projectingly provided on one end of the toner agitation chamber; and a toner carry and supply member for carrying the toner from the toner carry-in path into the toner agitation chamber along the axis of the developing roll and for supplying the toner from the toner agitation chamber onto the developing roll, the toner carry and supply member being established so that the quantity of toner carrying per unit time at the toner agitation chamber on the toner carry-in path side is larger than the quantity of toner carrying per unit time in the toner carry-in path.

10 Claims, 6 Drawing Sheets

DEVELOPING APPARATUS

BACKGROUND OF THE INVENTION

1. Field of the Invention

The present invention generally relates to a developing apparatus for use in a laser printer or an electrophotographic copying machine and particularly relates to a single-component toner developing apparatus in which the density of a recorded image can be maintained stably.

2. Description of the Prior Art

Conventionally, in the developing apparatus of the type mentioned above using a single-component toner as a developer, a developing apparatus as shown in FIG. 9 has been generally used. Specifically, the developing apparatus includes toner box a for accommodating magnetic toner T a developer carrier b (hereinafter referred to as a "developing roll") in which a plurality of magnets are fixedly provided in a rotatable cylindrical sleeve so as to adhere the magnetic toner T onto the sleeve by magnetic force, and a blade c which is pressed against the developing roll b by pressure so as to form the toner T adhered on the developing roll b into a thin layer. With such a configuration, the thin-layered toner T is transferred onto an electrostatic latent image carrier d by the action of an electrostatic field formed between the developing roll b and the electrostatic latent image carrier d so that an electrostatic latent image on the electrostatic latent image carrier d is developed.

In such a conventional developing apparatus, however, some constituent members may deteriorate as time passes because of fatigue, toner dirt, or the like, and it is therefore necessary to perform maintenance, such as exchanging those members based on the time of use of the members. In view of simplifying maintenance in equipment such as an electrophotographic copying machine, a laser printer, or the like, it is therefore preferable to make the configuration of the developing apparatus so that the members that require maintenance (such as a developing roll, a blade, and the like) are separately arranged from the members that require no maintenance (such as the toner box).

Further, in view of minimizing the size of such equipment, it is necessary to effectively use limited space around the electrostatic latent image carrier. It is therefore preferable that the developing apparatus be of small size and simple configuration.

3. Description of the Related Art

Recently, therefore, there has been proposed a developing apparatus in which a developing roll and the like are made in the form of units so that the unit developing apparatus and the like can be removably attached to a toner box. Specifically, as shown in FIGS. 10 and 11, a toner agitation chamber (hereinafter referred to as "an agitation chamber") e is provided along the axis of a developing roll b, and a toner carry and supply member f is disposed in the agitation chamber e so as to be parallel to the developing roll b. In such a configuration, toner T is made to fall from a toner box a located at the upper portion of the developing apparatus into a toner carry-in path i projectingly provided on one end of the agitation chamber e. Thereafter, the toner T is dispersed, by the toner carry and supply member f, in the longitudinal direction of the agitation chamber e so as to be supplied onto the developing roll b. Further, in such a configuration, a toner level sensor g (FIG. 10) for detecting the quantity of toner supplied into the agitation chamber e is provided in the agitation chamber e, and a dispenser roller h provided in the toner box a is driven on the basis of a detection signal from the sensor g when the quantity of residual toner in the agitation chamber e becomes small so that the toner T is made to fall into the agitation chamber e to thereby prevent the toner from being exhausted in the developing apparatus.

Here, when toner is longitudinally, horizontally carried into the agitation chamber provided adjacently, to the developing roll as described above, to prevent uneven density from occurring in a developed recorded-image, it is important to accumulate the toner substantially evenly in the agitation chamber without allowing the toner to accumulate unevenly at a part in the longitudinal direction in the agitation chamber.

It is, however, difficult to make toner accumulate evenly in the longitudinal direction, and toner is apt to accumulate somewhat unevenly although it can be prevented from accumulating extremely unevenly if the shape of the toner carry and supply member or the like is improved.

In the developing apparatus of this kind, the quantity of residual toner in the agitation chamber is detected by the toner level sensor as described above. A problem may, however, occur so that the quantity of residual toner cannot be correctly detected dependently on the attachment position of the level sensor upon occurrence of uneven toner accumulation. That is, where the attachment position of the level sensor in the longitudinal direction of the agitation chamber coincides with the area in which the quantity of toner accumulation is large and, thus, the level sensor mistakes the quantity of partial residual toner for the quantity of whole residual toner, the toner cannot be supplemented from the toner box before the quantity of residual toner in the agitation chamber becomes extremely small.

A problem therefore occurs that, when a recorded image in which the image area is wide, such as a so-called solid image, or the like, (hereinafter referred to as a "high-area coverage image") is developed, toner may be partially exhausted in the agitation chamber so that the electrostatic latent image cannot be developed in an area corresponding to the position where toner has been exhausted and, therefore, image information will be lacking.

Further, recently, a laser printer or the like has been used as a digital information output unit in facsimile equipment, computers, or the like, and the foregoing problem is one of the important problems to be solved, in such a printer. Such a printer operates in an unmanned state at any time in accordance with image information supplied through a circuit such that lack of an image due to defective development is not permissible or compared to a copying machine or the like in which an image is formed in accordance with the operation of an operator.

SUMMARY OF THE INVENTION

It is, therefore, an object of the present invention to solve the foregoing problems.

It is another object of the present invention to provide a developing apparatus in which carrying of toner in an agitation chamber and distribution of toner accumulation in the chamber are precisely controlled to prevent the toner from exhausting so that even a high-area coverage image can be satisfactorily developed.

In order to attain the foregoing objects, the inventors of the present invention have investigated means for solving the foregoing problems on the basis of the following points of view:

(1) The ability for carrying toner to an image portion area in a toner agitation chamber be improved;
(2) The attachment position of a toner level sensor be made appropriate to correctly detect the quantity of residual toner in the agitation chamber;
(3) The detecting ability of the toner level sensor be improved to reliably perform the supplementation of toner;
(4) Toner be carried in the agitation chamber smoothly to make distribution of tone accumulation substantially even.

As a result, the developing apparatus according to the present invention has been invented.

First, a developing apparatus according to a first aspect of the present invention is based on the foregoing view point (1). In the developing apparatus of this kind as described above, toner carried from the carry-in path into the agitation chamber is further carried by a carry and supply member in the longitudinal direction of the agitation chamber. At this time, if the quantity of toner carrying per unit time by means of the carry and supply member in the toner agitation chamber on the toner carry-in path side is smaller than the quantity of toner carrying per unit time in the toner carry-in path, the amount of toner becomes massive in the carry-in path to provide a factor in causing reduction of the toner carrying ability.

Therefore, the developing apparatus according to the first aspect of the present invention comprises: a developing roll for carrying single-component toner to a developing area facing an electrostatic latent image carrier; a toner agitation chamber provided along an axis of the developing roll; a toner carry-in path projectingly provided on one end of the toner agitation chamber; and toner carry and supply means for carrying the toner from the toner carry-in path into the toner agitation chamber along the axis of the developing roll and for supplying the toner from the toner agitation chamber onto the developing roll, the toner carry and supply means being established so that the quantity of toner carrying per unit time at the toner agitation chamber on the toner carry-in path side is larger than the quantity of toner carrying per unit time in the toner carry-in path.

A developing apparatus according to a second aspect of the present invention is also based on the foregoing view point (1). That is, in this developing apparatus, the ratio of the number of rotation of a toner carry and supply member to that of a developing roll is defined so that the quantity of toner carrying and the quantity of toner consumption are balanced with each other to prevent the toner from being exhausted in the agitation chamber.

That is, the developing apparatus according to the second aspect of the present invention comprises: a developing roll rotatable for carrying single-component toner to a developing area facing an electrostatic latent image carrier; a toner agitation chamber provided along an axis of the developing roll; a toner carry-in path projectingly provided on one end of the toner agitation chamber; and a toner carry and supply member rotatable for carrying the toner from the toner carry-in path into the toner agitation chamber along the axis of the developing roll and for supplying the toner from the toner agitation chamber onto the developing roll, the toner carry and supply member having a toner agitation mechanism correspondingly to an image portion area and having a toner carrying mechanism correspondingly to a non-image portion area, the value n of a ratio of the number of rotation of the carry and supply member to that of the developing roll being established to satisfy the condition of $0.4<n<1.5$.

Further, a developing apparatus according to a third aspect of the present invention is based on the foregoing view point (2). The quantity of toner consumption in the agitation chamber is not always even in the longitudinal direction of the agitation chamber, and, therefore, the quantity of toner accumulation is apt to become partially uneven. The inventors of this application therefore considered that the quantity of residual toner in the agitation chamber could be correctly detected to prevent the toner from being exhausted if the attachment position of the toner level sensor was determined on the basis of the relation between the position of the toner level sensor and the quantity of toner consumption. Thus, the inventors have attained this invention.

That is, the developing apparatus according to the third aspect of the present invention comprises: a developing roll for carrying single-component toner to a developing area facing an electrostatic latent image carrier; a toner agitation chamber provided along an axis of the developing roll; a toner carry-in path projectingly provided on one end of the toner agitation chamber; toner carry and supply means for carrying the toner from the toner carry-in path into the toner agitation chamber along the axis of the developing roll and for supplying the toner from the toner agitation chamber onto the developing roll; and sensing means for detecting a quantity of toner accumulation in the agitation chamber, the sensing means being attached at a central position of an area where a quantity of toner consumption is high in the agitation chamber.

Moreover, a developing apparatus according to a fourth aspect of the present invention is based on the foregoing viewpoint (3). Generally, toner level sensor provided in the agitation chamber serves to detect existence of toner through contact with toner at the front surface of the sensor, and the output of the sensor is, therefore, extremely unstable because of contact of a sensor cleaning member with the sensor, residual adhesion of toner on the sensor, or the like.

Accordingly, a problem occurs that supplementation of toner which is performed on the basis of the output of the sensor becomes unstable and the quantity of toner in the agitation chamber does not remain. The developing apparatus according to the fourth aspect of the present invention is intended to solve the foregoing problem to maintain the quantity of toner accumulation in the agitation chamber substantially fixed.

That is, the developing apparatus according to the fourth aspect of the present invention comprises: a developing roll for carrying single-component toner to a developing area facing an electrostatic latent image carrier; a toner agitation chamber provided along an axis of the developing roll; a toner carry-in path projectingly provided on one end of the toner agitation chamber; a toner carry and supply member for carrying the toner from the toner carry-in path into the toner agitation chamber along the axis of the developing roll and for supplying the toner from the toner agitation chamber onto the developing roll; sensing means provided in the toner agitation chamber for detecting a quantity of toner accumulation in the agitation chamber; and toner supply control means connected to the sensing means for judging whether the toner agitation chamber is empty or filled with toner upon detection of continuous presence or absence of the toner.

Further, a developing apparatus according to a fifth aspect of the present invention is based on the foregoing viewpoint (4). When a toner level sensor is provided in the agitation chamber, generally, a cleaning member for removing residual toner adhering on the detecting surface of the sensor is provided to prevent the sensor from detecting erroneously. As the cleaning member, a plate-like cleaning member has been attached on the toner carry and supply member so that the front end of the cleaning member abuts the detecting surface as the toner carry and supply member rotates. When the sensor is cleaned by the rotation of such a plate-like cleaning member, however, the following problems are caused:

(1) Since the cleaning member rotates in an image region of the agitation chamber, the cleaning member disturbs toner carrying operation to reduce the toner carrying ability in the agitation chamber; and (2) Since the cleaning member rotates while removing toner, the toner level decreases at the attachment position of the cleaning member, that is, at the attachment position of the sensor, so that the toner level cannot be correctly detected.

The inventors of this application therefore investigated earnestly and considered that the foregoing problems (1) and (2) could be solved by contriving the shape of the cleaning member so that distribution of toner accumulation could be controlled so as to be substantially even. As a result, the developing apparatus according to the fifth aspect of the present invention has been attained.

That is, the developing apparatus according to the fifth aspect of the present invention comprises: a developing roll for carrying single-component toner to a developing area facing an electrostatic latent image carrier; a toner agitation chamber provided along an axis of the developing roll; a toner carry-in path projectingly provided on one end of the toner agitation chamber; a toner carry and supply member rotatable for carrying the toner from the toner carry-in path into the toner agitation chamber along the axis of the developing roll and for supplying the toner from the toner agitation chamber onto the developing roll; a toner level sensor having a detection surface exposed to the toner agitation chamber for detecting a quantity of toner accumulation in the agitation chamber; and cleaning means attached on the toner carry and supply member for cleaning the detection surface with the rotation of the carry and supply member, the cleaning means having one of a substantially U-shaped plate-like member and a substantially square-shaped plate-like member.

The foregoing operate as follows.

In the developing apparatus according to the first aspect of the present invention, toner smoothly flows in the vicinity of the inlet of the toner agitation chamber to improve the toner carrying ability, and extreme reduction in the quantity of toner accumulation in the agitation chamber is prevented.

In the developing apparatus according to the second aspect of the present invention, the quantity of toner supplied into the agitation chamber and the quantity of toner consumption are balanced with each other. The quantity of toner accumulation in the agitation chamber can be maintained to be substantially fixed so that the reduction of the quantity of toner accumulation in the agitation chamber is prevented.

In the developing apparatus according to the third aspect of the present invention, toner is supplemented into the agitation chamber on the basis of the region in which the quantity of toner accumulation is apt to decrease so that the extreme decrease in the quantity of toner accumulation is prevented.

In the developing apparatus according to the fourth aspect of the present invention, erroneous detection as to empty/fullness of toner in the agitation chamber can be prevented so that the quantity of toner accumulation in the agitation chamber can be maintained to be substantially fixed.

In the developing apparatus according to the fifth aspect of the present invention, the cleaning member is substantially U-shaped or square-shaped so as to have an opening at its central portion so that carrying of toner is barely influenced by rotation of the cleaning member and the even distribution of toner accumulation is accomplished.

DETAILED DESCRIPTION OF THE PREFERRED EMBODIMENTS

The developing apparatus according to the present invention will be described in detail hereunder with reference to the accompanying drawings.

Figure 1:
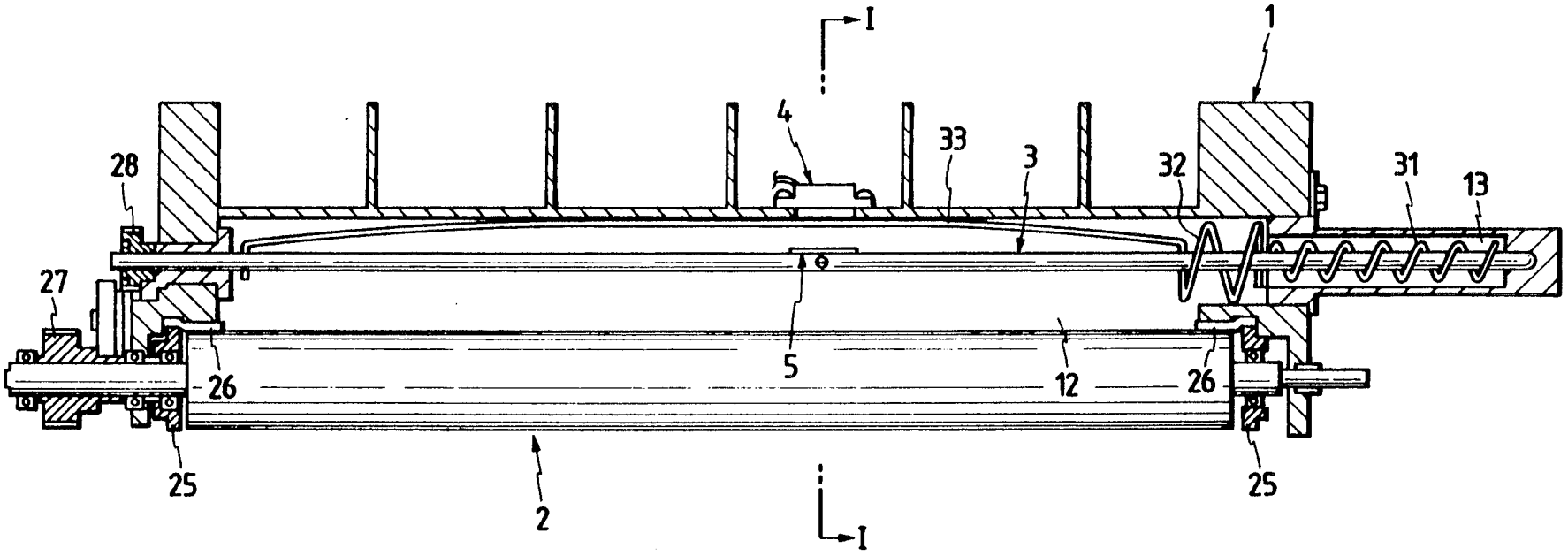
FIG. 1 is a sectional plan showing a first embodiment of the developing apparatus according to the present invention.
Figure 2:
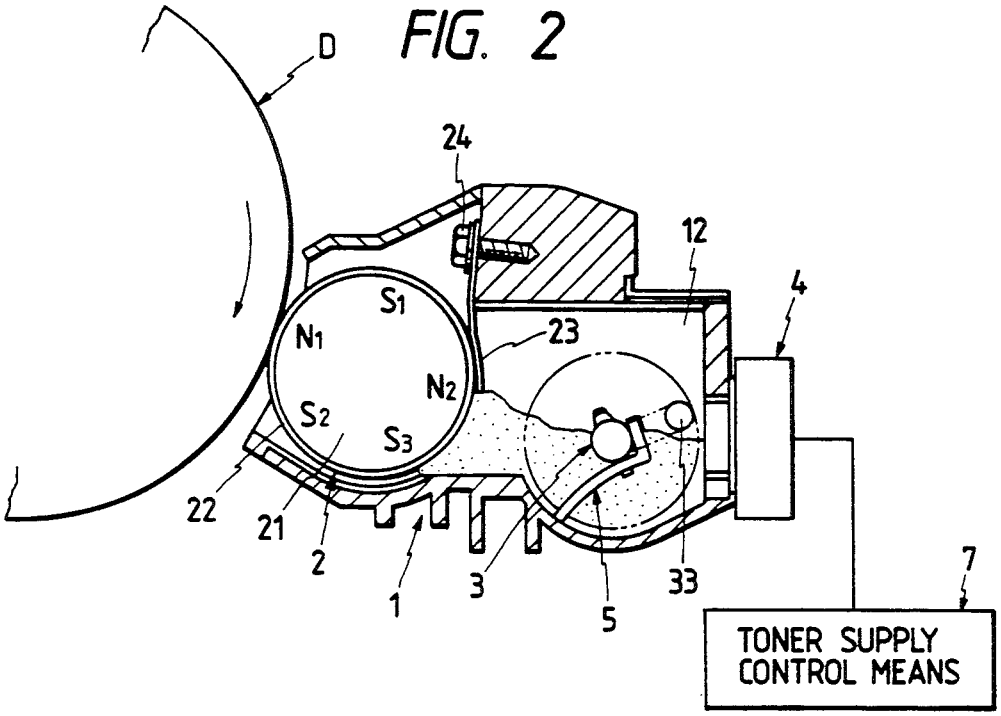
FIG. 2 is a sectional view taken on line I—I of FIG. 1.

FIGS. 1 and 2 show the configuration of an embodiment of the developing apparatus according to the present invention which includes a developing roll (toner carrier) 2 provided on one end of a housing 1 so that its outer circumferential surface is partially exposed at the outside of the housing 1, a toner agitation chamber 12 provided in the housing 1 along the axis of the developing roll 2, and a toner carry and supply member 3 for carrying single-component magnetic toner into the agitation chamber 12.

The developing roll 2 has a fixedly supported substantially columnar magnet member 21 and a cylindrical sleeve 22 rotatably provided on the outer circumference side of the columnar magnet member 21 so that the magnetic toner in the agitation chamber 12 is attracted onto the outer circumferential surface of the sleeve 22 by the magnetic force of the magnetic member 21 and carried, with rotation of the sleeve 22, to a developing region facing an electrostatic latent image carrier D. Further, a blade 23 is fixed on an upper portion of the housing 1 by screws 24 so as to be urged against the outer peripheral surface of the sleeve 22 so that the magnetic toner attracted on the outer peripheral surface of the sleeve 22 is made to be a thin layer by blade 23. As seen in FIG. 1, the configuration further includes a pair of tracking rolls 25 which are provided coaxially with the developing roll 2 through bearings to keep a gap between the developing roll 2 and the electrostatic latent image carrier D, and a pair of seal members 26 which are provided to seal gaps between the housing 1 and the developing roll 2 to prevent toner from leaking from the housing 1.

On the other hand, the toner carry and supply member 3 is a rod-like member which rotates while passing through the agitation chamber 12 and a toner carry-in path 13 projectingly provided in the housing 1 and communicated with the agitation chamber 12. Toner is made to fall into the toner carry-in path 13 from a toner box (not shown) located at an upper portion in the developing apparatus. The toner carry and supply member 3 carries this toner from the toner carry-in path into the agitation chamber 12 and supplies the toner from the agitation chamber 12 onto the developing roll 2.

Gears 27 and 28 are fitted on the axial one ends of the developing roll 2 and the toner carry and supply member 3, respectively, and connected to drive motors (not shown) so as to be rotated at a predetermined rotational speed. In the developing apparatus according to this embodiment, the side at which the toner carry-in path 13 extends and the side at which the gears 27 and 28 are provided will be referred to as "the front side" and "the rear side", respectively. Further, the toner carry and supply member 3 is provided, at its portion corresponding to the carry-in path 13, with a spiral plate-like toner carrying mechanism or auger 31, and provided, at its portion corresponding to a portion of the agitation chamber 12 in the vicinity of the carry-in path 13, with a spiral coil- like toner carrying mechanism or agitator 32, the quantity of toner carrying per unit time by the agitator 32 being established so as to be larger than that by the auger 31. The auger 31 and the agitator 32 are provided for the purpose of reducing the density of toner in the carry-in path 13 to prevent the toner from becoming massive in the carry-in path 13 so that the toner can be smoothly carried into the agitation chamber 12. In this embodiment, the respective diameters of the auger 31, the carry-in path 13, the agitator 32 and the agitation chamber 12 were selected to be 12 mm, 14 mm, 26 mm and 28 mm, respectively. Thus, the diameter of the agitator 32 is selected to be larger than that of the auger 31 to make the quantity of toner carrying per unit time larger.

Further, the toner carry and supply member 3 is provided, at its portion facing the developing roll 2, with an agitation bar or agitation mechanism 33 which is disposed so as to be substantially in parallel to the axis of the developing roll 2 and so as to continue to the agitator 32, so that agitation of toner and pushing-out of the toner to the developing roll 2 are performed as the member 3 rotates.

Therefore, toner that falls from the toner box into the carry-in path 13 is carried by the toner carrying mechanism constituted by the auger 31 and the agitator 32 in a region such as the carry-in path 13 and the like which is not opposite the developing roll 2, that is, in a non-image portion area. However, the toner is, carried from the front side to the rear side by the pressing force of toner sent into the agitation chamber 12 because the toner carry and supply member 3 has no toner carrying force in an area opposite to the developing roll 2, that is, in the image portion area.

Consequently, the quantity of toner carrying per unit time in the image portion area is established to be smaller than that in the non-image portion area so that toner is prevented from being unevenly accumulated at the rear side of the agitation chamber 12 because of excessive carrying. As a result, in the developing apparatus according to this embodiment, the quantity of accumulation of toner is made to be even over the image portion area from the front side to the rear side so that the quantity of toner supplied onto the developing roll 2 is made substantially even in the axial direction of the developing roll 2.

Figure 3:
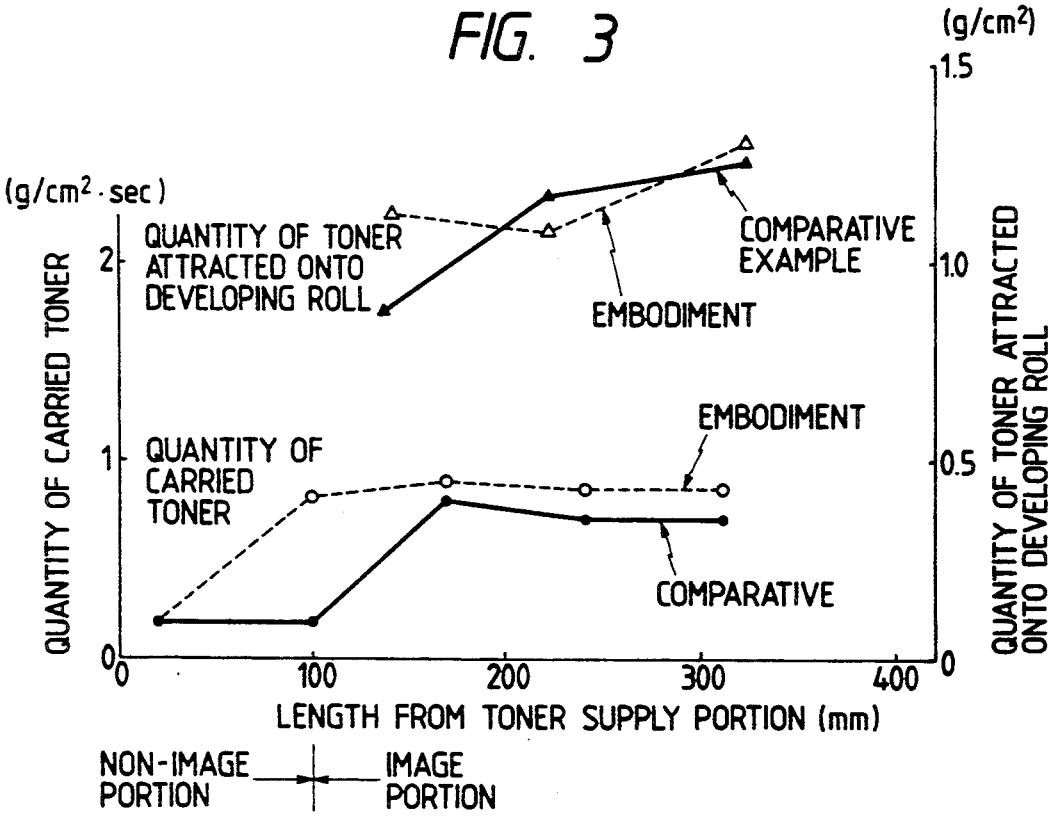
FIG. 3 is a graph showing the results of experiment performed as to the quantity of toner carrying by the toner carry and supply members in the first embodiment and that in the comparative example.

FIG. 3 shows the results of the toner carrying experiment which was made by the inventors of this application in order to confirm the effect of the toner carry and supply member 3 which was shaped in a manner as described above. In this experiment, a housing 1 having a non-image portion area of 100 mm length was used. A toner carry and supply member (1) (corresponding to this embodiment) in which the length of the carrying mechanism was equal to that of the non-image portion and another toner carry and supply member (2) (a comparative example) in which the carrying mechanism of 150 mm was longer than the non-image portion were prepared. The thus prepared members (1) and (2) were alternatively incorporated into the housing 1, and the quantity of toner carrying was examined at several points in the longitudinal direction of the agitation chamber 12.

Further, at this time, the quantity of toner attracted onto the developing roll 2 per unit area was examined.

Apparent from the experiment results, in the comparative example, the quantity of toner carrying varied extremely in the image portion area and hence the quantity of toner on the developing roll varied extremely correspondingly. In this embodiment, on the contrary, the quantity of toner carrying was substantially fixed in the image portion area, and the quantity of toner on the developing roll was substantially fixed which differed from the comparative example. In this embodiment, therefore, it was found that toner was accumulated not partially unevenly but substantially evenly in the image portion area, and it could be confirmed that the foregoing shape of the toner carry and supply member 3 was effective in preventing toner from exhausting in the agitation chamber 12.

Then, toner carried into the agitation chamber 12 and evenly accumulated therein is carried out to the developing area as the developing roll 2 rotates and is consumed in the developing area. Therefore, in order to prevent toner from exhausting in the agitation chamber 12, it is necessary to establish the quantity of toner carried into the agitation chamber 12 to be appropriate with respect to the quantity of toner consumed for development.

Figure 4:
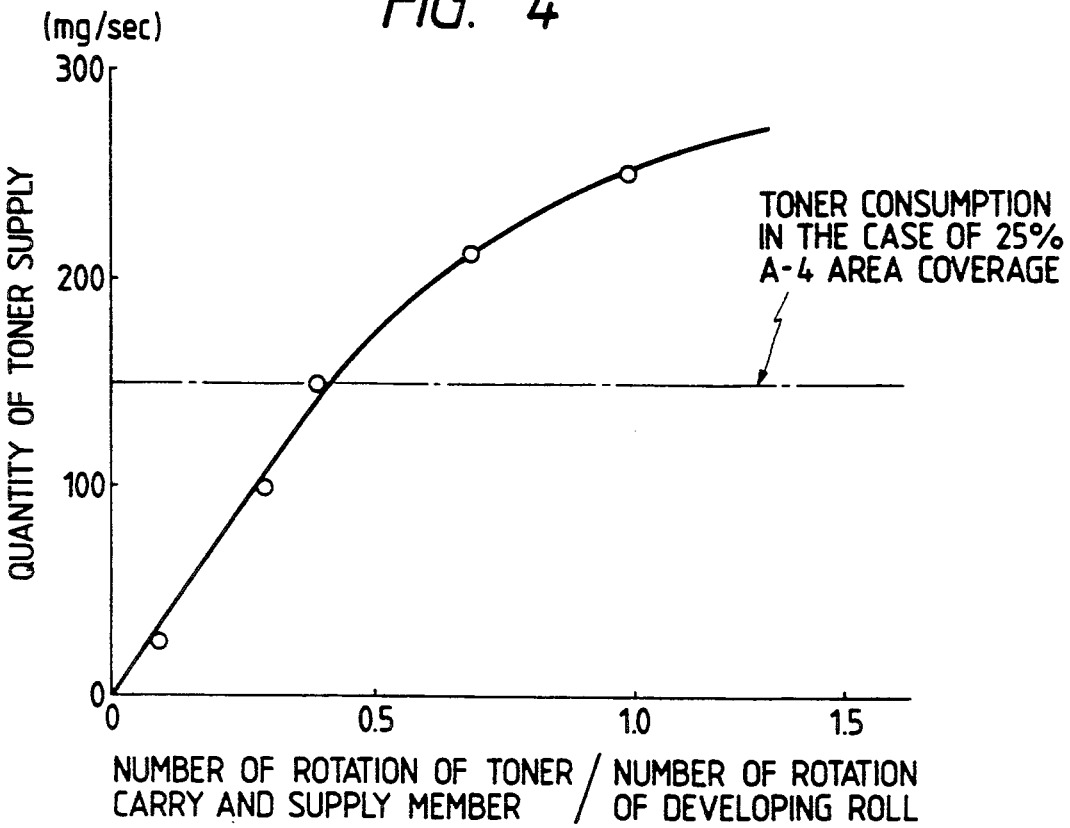
FIG. 4 is a graph showing the results of experiment performed as to the relation between the number of rotation of the toner carry and supply member and the quantity of toner supply.

Then, the inventors of this application examined the relation between the quantity of toner carried into the agitation chamber 12 and the value n of the ratio of the number of rotation of the toner carry and supply member 3 to that of the developing roll 2 and determined the ratio value n on the basis of the quantity of toner consumed when an image having an area coverage of 25% was formed on an A-4 size recording sheet. FIG. 4 shows the results.

As illustrated in FIG. 4, the quantity of toner supply improves rapidly as the ratio value n increases. When the ratio value n is 1.5 or more, however, the increase in improvement in quantity of toner supply lessens, and when the ratio value n is 0.4 or more, toner can be carried into the agitation chamber 12 by a quantity over the quantity of toner consumption in the case of 25% A-4 area coverage. Since the area coverage is about 20% at largest in the case of an ordinary recording image, toner can be sufficiently prevented from being exhausted in the agitation chamber 12 if the ratio value n takes a value in the range of $0.4<n<1.5$. Thus, this embodiment is intended to prevent toner from being exhausted in the agitation chamber 12 by selecting the rotational speed of the toner carry and supply member 3 to be 36.2 rpm relative to the rotational speed 78.7 rpm of the developing roll 2.

Figure 7:
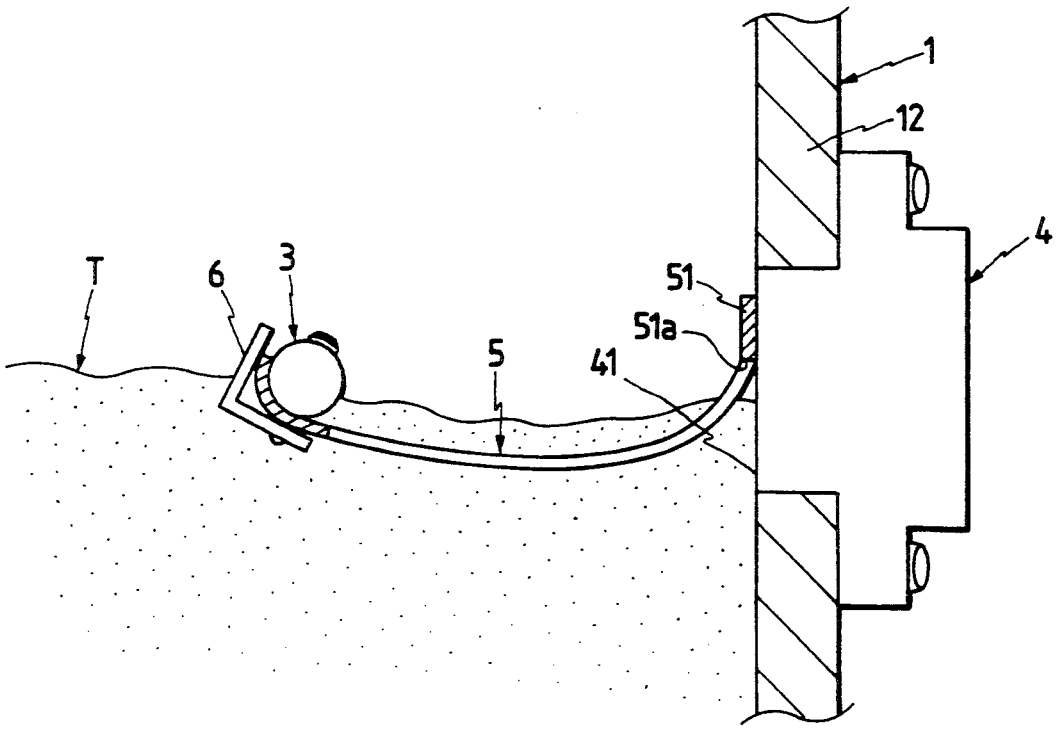
FIG. 7 is a side view showing the state in which the cleaning member is performing its cleaning operation.

Further, in this embodiment, as illustrated in FIGS. 2 and 7 a toner level sensor (hereinafter simply referred to as a "sensor") 4 for detecting the quantity of toner accumulation is attached on the housing 1 at a portion thereof on the agitation chamber 12 side. The sensor 4 has a piezo-electric element provided on its detection surface 41, as shown in FIG. 7, which is exposed to the agitation chamber 12 so as to detect existence of toner from the vibratory state of the piezo-electric element. Specifically, a predetermined voltage is applied to the piezo-electric element so as to bring the piezo-electric element into a high-frequency vibratory state. In this condition, if toner of a predetermined quantity or more comes into contact with the piezo-electric element, a change is caused in the vibratory state and, therefore, a change is caused in the voltage value. Thus, presence or absence of toner can be detected by the change of the voltage value.

Next, the attachment position of the sensor 4 will be described.

In the developing apparatus according to this embodiment, the width of the image portion area and the length of the developing roll 2 are selected so that an electrostatic latent image of A-3 size at the largest can be developed. Accordingly, when an electrostatic latent image of another size, such as A-4 size or the like, is to be developed, development is, performed by using only a part of the image area. The quantity of toner consumption in the agitation chamber 12 is, therefore, partially different, and it is necessary to detect the quantity of toner accumulation, that is, the toner level, in the position where the quantity of toner consumption is high so that toner is prevented from being exhausted.

Figure 5:
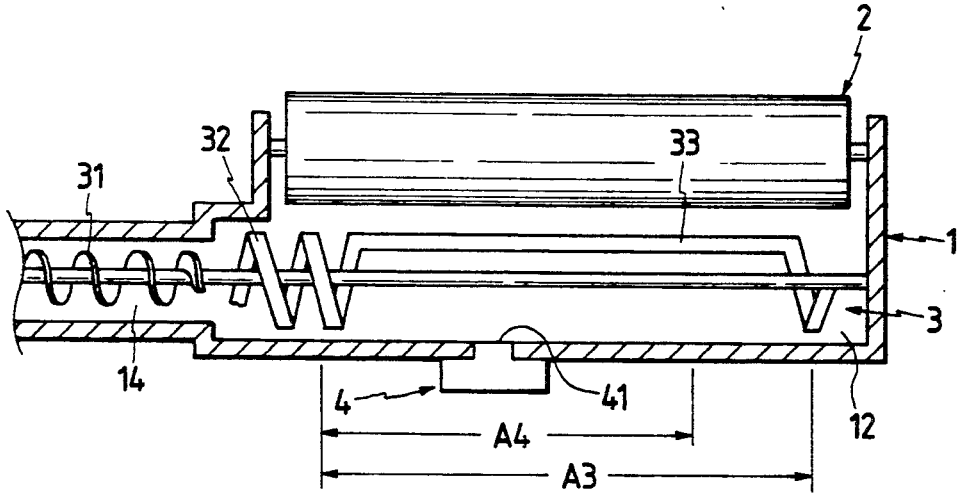
FIG. 5 is a schematic view for explaining the attachment position of the toner level sensor.

In this embodiment, accordingly, the sensor 4 is attached at the central position of A-4 size as shown in FIG. 5 on the assumption of the case where an A-4 size electrostatic latent image is developed on the basis of the front side because A-4 size electrostatic latent image is considered to be the highest in frequency of development.

If the attachment position of the sensor 4 is investigated from another point of view, there is a slight time lag between a time point at which an output is produced from the sensor 4 and a time point at which toner made to fall into the carry-in path 13 in response to the output of the sensor 4 is carried to the attachment position of the sensor 4. Accordingly, in order to minimize the time lag, it is preferable to attach the sensor 4 at a position near the front side and within the image portion area. In the case where a position extremely near the non-image portion area is selected, however, it is difficult to correctly detect the toner level because the sensor 4 is apt to be influenced by the toner carrying in the non-image portion area. In order to correctly control the toner level in the agitation chamber, therefore, it is preferable to attach the sensor 4 at a position which is somewhat away from the non-image portion area and which is on the front side rather than the center of the image portion area. In this embodiment, the attachment position of the sensor 4 satisfies the above condition and also is considered the most suitable one in view of toner carrying control as well as tone level control.

Although the case where images of various sizes are developed on the basis of the front side has been described by way of example in the developing apparatus according to this embodiment, it is a matter of course that the most suitable attachment position of the sensor 4 is changed if development is performed on the basis of the rear side or the center of the image area.

Figure 6:
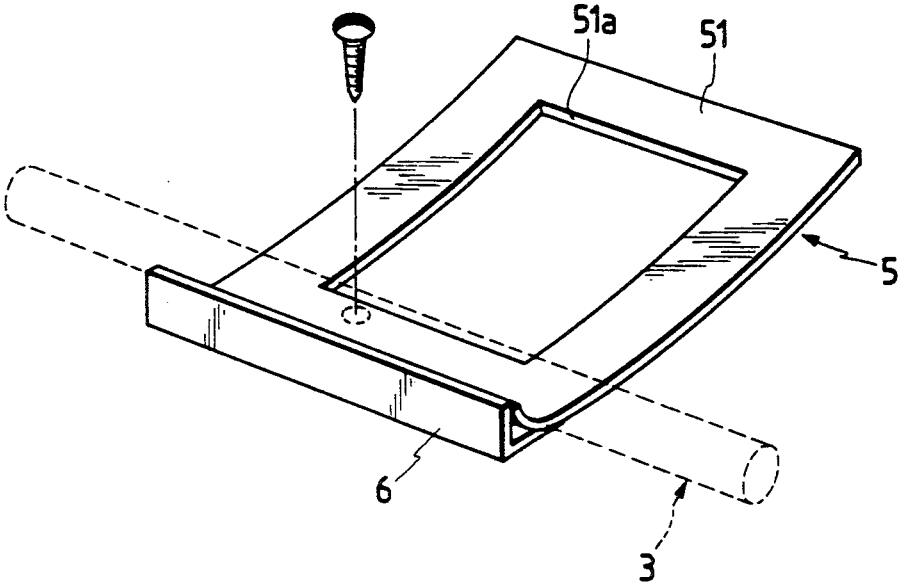
FIG. 6 is an enlarged perspective view showing the attachment position of the cleaning member.

Further, in the developing apparatus according to this embodiment, a member 5 for cleaning the detection surface, 41 of the sensor 4 is provided so as to prevent erroneous tones level detection from being performed because of residual toner adhering on the detection surface 41. As shown in FIGS. 2, 6, and 7, the cleaning member 5 is an elastic plate-like member screwed on the rotary shaft of the toner carry and supply member 3 so that toner adhering on the detection surface 41 is scraped off with the rotation of the carry and supply member 3.

Specifically, the substantially U-shaped (or square-shaped) cleaning member 5, opened at its central portion, is produced from a resin sheet of, for example, Mylar or the like, or from a metal thin plate, or the like, and screwed on the carry and supply portion 3 by using a substantially L-shaped holder 6 in section, as shown in FIG. 6. In the cleaning member 5, the side thereof parallel to the rotary shaft of the carry and supply member 3 acts as a cleaning portion 51 and abuts on the detection surface 41 as shown in FIG. 7 so that scraping of toner T is performed by an inside end 51*a* of the cleaning portion 51.

To this end, after cleaning the detection surface 41, the cleaning portion 51 sinks so as to cut the accumulated toner T so that it is possible to perform cleaning without removing the toner from the front of the sensor 4. Further, since the cleaning member 5 is opened in the central portion, the cleaning portion 51 hardly disturbs toner carrying to the rear side at the time of rotation thereof so that the toner level is made even in the agitation chamber 12 from its front side to its rear side.

Also in this regard, the developing apparatus according to this embodiment can precisely control distribution of toner accumulation in the agitation chamber 12.

Further, in this embodiment, a toner supply control means 7 (FIG. 2) for judging presence/absence of toner in the agitation chamber 12 on the assumption that the sensor 4 has detected presence/absence of toner continuously for a predetermined time or more is provided for the purpose of preventing erroneous detection of the sensor 4 from occurring. Specifically, after the sensor 4 has detected absence of toner continuously for a predetermined time $T_1$ (500 msec in this embodiment), the toner supply control means 7 makes a conclusion that toner is absent so that a dispense motor provided in the toner box is driven to make the toner fall into the carry-in path 13, as shown in a timing chart of FIG. 8. After the sensor 4 has detected presence of toner continuously for a predetermined time $T_2$ (2 sec in this embodiment), on the other hand, the supply control means 7 makes a conclusion that toner is present so that the dispense motor is stopped.

Figure 8:
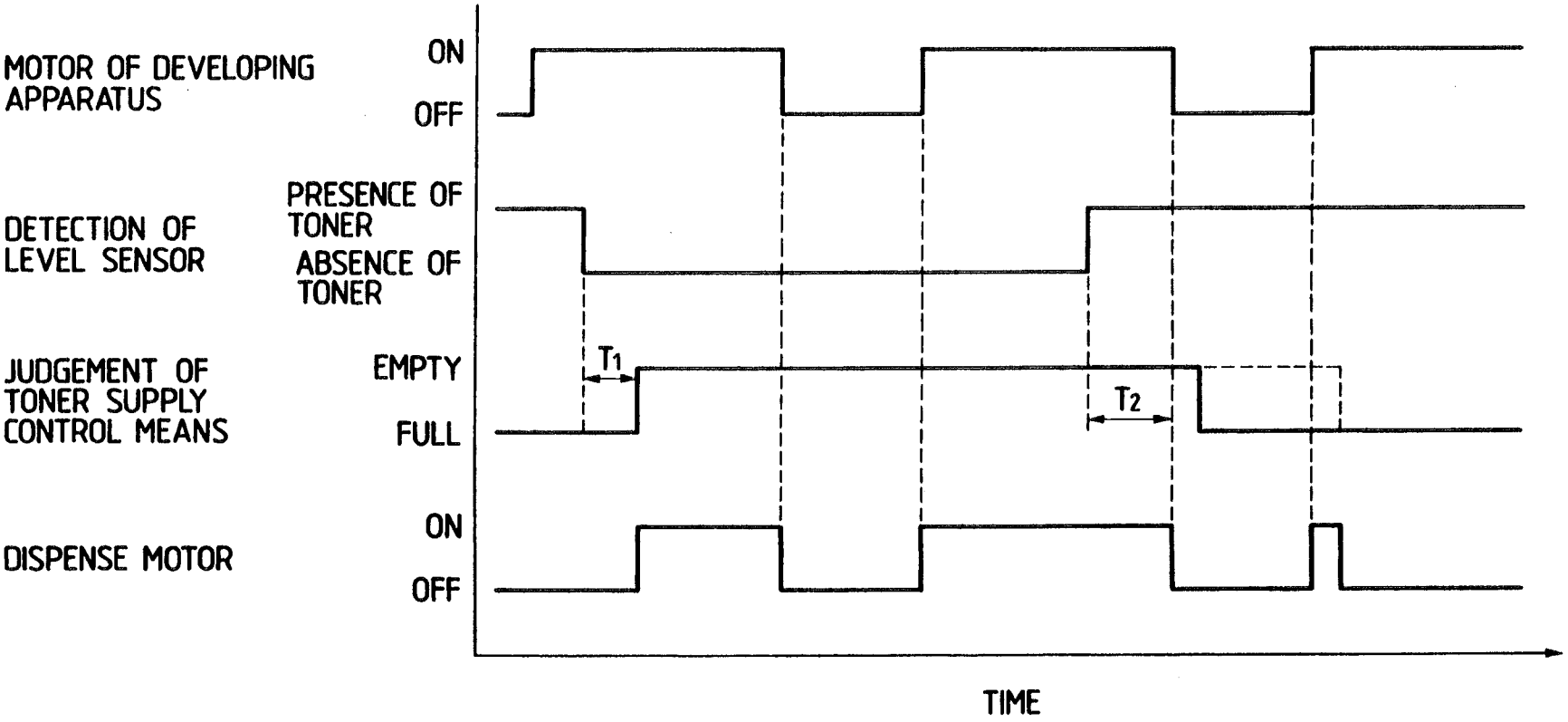
FIG. 8 is a timing chart showing the relation between a detection signal of the toner level sensor and supplementation of toner.
Figure 9:
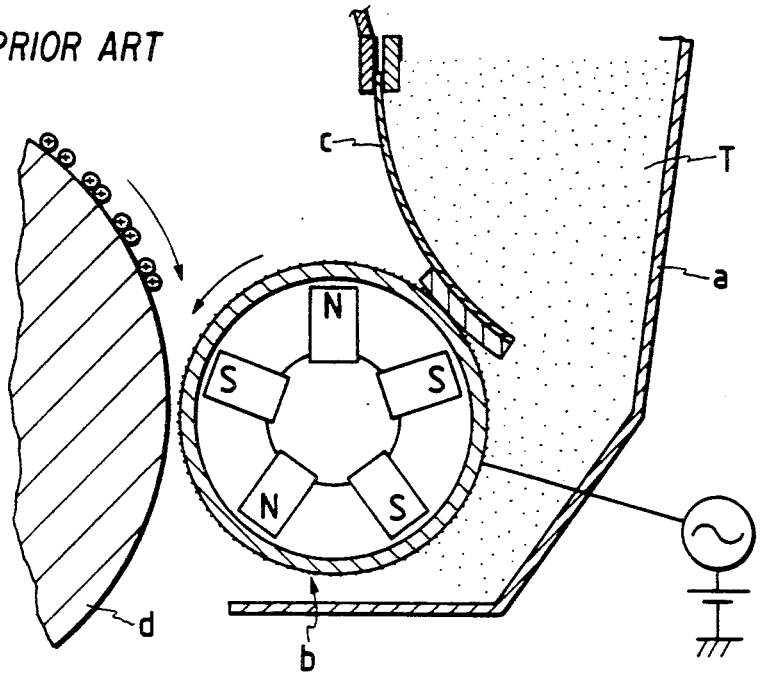
FIG. 9 PRIOR ART
FIG. 9 is a schematic view showing a representative example of the conventional single-component developing apparatus.
Figure 10:
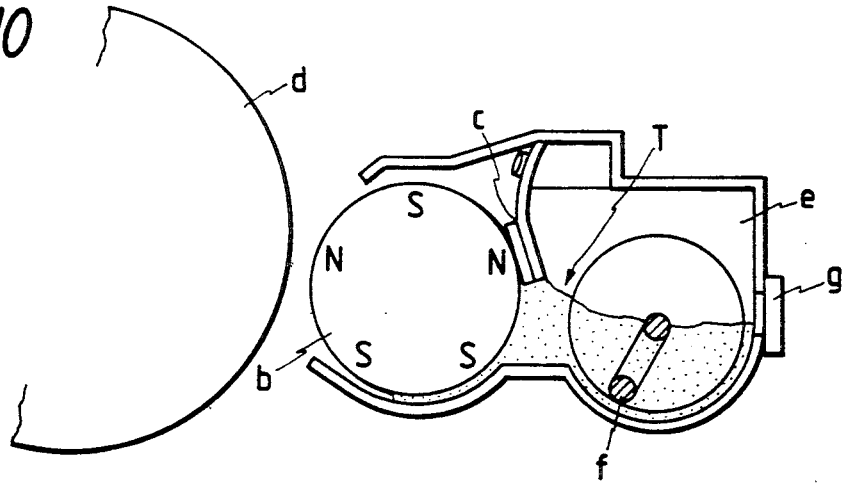
FIGS. 10 and 11 are front and side sectional views showing an example of the single-component developing apparatus which is the related art of the present invention.
Figure 11:
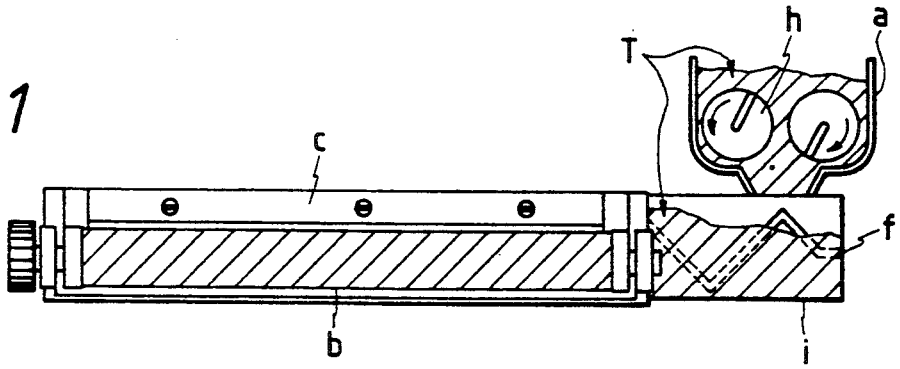

As seen from FIG. 8, the dispense motor is not driven when the motor of the developing apparatus is not driven. This is because toner is allowed to fall into the carry-in path 13 only when the carry and supply member 3 is rotating. When it is concluded that toner is present after the dispense motor has stopped, the time from a time point at which the motor is stopped to a time point at which the conclusion is made is counted by a timer, and the dispense motor is driven in the next driving of the developing apparatus for the time corresponding to the count value of the timer to make assurance doubly sure of toner supplement.

The foregoing times $T_1$ and $T_2$ are closely related with the operation of the cleaning member 5 because they are set for the purpose of preventing the detecting ability from being reduced by contacting of the cleaning member 5 with the sensor 4. That is, when it is to be concluded that toner is absent, it is necessary that the time $T_1$ is longer than a time (about 300 msec although it varies depending on the flowability or the like of toner) which is required for the toner scraped from the front detection surface 41 with rotation of the cleaning member 5 to recover to its original state. When it is concluded that toner is absent, on the contrary, it is necessary that the time $T_2$ is longer than a time which is required for the cleaning member 5 to pass the detection surface 41 of the sensor 4.

In the developing apparatus according to this embodiment, by preventing erroneous detection from occurring in the sensor 4 as described above, the toner detecting ability of the sensor 4 is used at its maximum to reliably perform toner supplementation into the agitation chamber 12 so that toner can be prevented from being exhausted in development.

As described above, the developing apparatus according to this embodiment has the various structural features in which the toner carrying and toner level in the agitation chamber 12 can be properly controlled so that the toner supply to the image area of the agitation chamber 12 is reliably performed to thereby make it possible to perform development of a high-area coverage image.

As described above, in each of the developing apparatus according to various aspects of the present invention, the quantity of toner accumulation in the image portion area in the toner agitation chamber does not decrease extremely and the distribution of toner accumulation in the agitation chamber is kept substantially even so that toner is prevented from being exhausted in developing a high-area coverage image. An electrostatic latent image formed on the latent image carrier is therefore developed so that it is possible to obtain a high-definition recorded image without information gap.

In the developing apparatus according to this embodiment, the toner carry and supply means may, of course, be modified where appropriate, for example, in the arrangement of the number of rotating carrying members, single or plural, as long as the toner carry and supply means are established so that the quantity of toner carrying per unit time at the toner agitation chamber on the toner carry-in path side is larger than the quantity of toner carrying per unit time in the toner carry-in path.

The sensing means may, of course, be modified where appropriate, for example, in the arrangement of the number of the toner level sensors, single or plural, as long as the sensing means is attached at a central position of an area where a quantity of toner consumption is high in the agitation chamber. That is, a plurality of toner level sensors may be longitudinally provided in the toner agitation chamber along the axis of the developing roll.

Like the sensing means, the cleaning means may, of course, be modified where appropriate, for example, in the arrangement of the number of plate-like members, as long as the cleaning means attains the purpose of cleaning the detection surfaces of the sensing means.

What is claimed is:

1. A developing apparatus comprising:

a developing roll for carrying single-component toner to a developing area facing an electrostatic latent image carrier;

a toner agitation chamber provided along an axis of said developing roll;

a toner carry-in path projectingly provided on one end of said toner agitation chamber; and toner carry and supply means for carrying the toner from said toner carry-in path into said toner agitation chamber along said axis of said developing roll and for supplying the toner from said toner agitation chamber onto said developing roll, said toner carry and supply means being established so that a first quantity of toner carrying per unit time at said toner agitation chamber on said toner carry-in path side is larger than a second quantity of toner carrying per unit time in said toner carry-in path.

2. The developing apparatus according to claim 1, wherein said toner carry and supply means includes first carrying means at a portion corresponding to a portion of said toner agitation chamber in a vicinity of said toner carry-in path for carrying the toner at said first quantity, and second carrying means at a portion corresponding to said toner carry-in path for carrying the toner at said second quantity.

3. The developing apparatus according to claim 2, wherein said toner carry and supply means further includes agitation means along a portion facing said developing roll for agitating the toner within said toner agitation chamber and pushing the toner toward said developing roll.

4. A developing apparatus comprising:

a developing roll rotatable for carrying single-component toner to a developing area facing an electrostatic latent image carrier;

a toner agitation chamber provided along an axis of said developing roll;

a toner carry-in path projectingly provided on one end of said toner agitation chamber; and a toner carry and supply member rotatable for carrying the toner from said toner carry-in path into said toner agitation chamber along said axis of said developing roll and for supplying the toner from said toner agitation chamber onto said developing roll, said toner carry and supply member having a toner agitation mechanism correspondingly to an image portion area and having a toner carrying mechanism correspondingly to a non-image portion area, the value n of a ratio of the number of rotation of said carry and supply member to that of said developing roll being established to satisfy the condition of $0.4<n<1.5$.

5. A developing apparatus comprising:

a developing roll for carrying single-component toner to a developing area facing an electrostatic latent image carrier;

a toner agitation chamber provided along an axis of said developing roll;

a toner carry-in path projectingly provided on one end of said toner agitation chamber;

toner carry and supply means for carrying the toner from said toner carry-in path into said toner agitation chamber along said axis of said developing roll and for supplying the toner from said toner agitation chamber onto said developing roll; and sensing means for detecting a quantity of toner accumulation in said agitation chamber, said sensing means being attached at a central position of an area where a quantity of toner consumption is high in said agitation chamber.

6. The developing apparatus according to claim 5, wherein said sensing means includes a toner level sensor having a piezo-electric element exposed to said toner agitation chamber so that the toner is kept in contact with said piezo-electric element when the toner is accumulated with said toner agitation chamber at a predetermined amount.

7. A developing apparatus comprising:

a developing roll for carrying single-component toner to a developing area facing an electrostatic latent image carrier;

a toner agitation chamber provided along an axis of said developing roll;

a toner carry-in path projectingly provided on one end of said toner agitation chamber;

toner carry and supply means for carrying the toner from said toner carry-in path into said toner agitation chamber along said axis of said developing roll and for supplying the toner from said toner agitation chamber onto said developing roll;

sensing means provided in said toner agitation chamber for detecting a quantity of toner accumulation in said agitation chamber; and toner supply control means connected to said sensing means for judging whether said toner agitation chamber is empty or filled with toner upon detection of continuous presence or absence of the toner.

8. The developing apparatus according to claim 7, further comprising toner supply means for supplying said toner carry-in path with the toner based on judgement of said toner supply control means.

9. The developing apparatus according to claim 8, wherein said control means controls said supply means to supply said toner carry-in path with the toner when said sensing means detects absence of the toner within said agitation chamber continuously for a first predetermined time, and to cease the supply of the toner when said sensing means detects presence of the toner within said agitation chamber continuously for a second predetermined time.

10. A developing apparatus comprising:

a developing roll for carrying single-component toner to a developing area facing an electrostatic latent image carrier;

a toner agitation chamber provided along an axis of said developing roll;

a toner carry-in path projectingly provided on one end of said toner agitation chamber;

toner carry and supply means rotatable for carrying the toner from said toner carry-in path into said toner agitation chamber along said axis of said developing roll and for supplying the toner from said toner agitation chamber onto said developing roll;

at least one toner level sensor, each having a detection surface exposed to said toner agitation chamber for detecting a quantity of toner accumulation in said agitation chamber; and cleaning means attached to said toner carry and supply means for cleaning said detection surface with the rotation of said carry and supply means, said cleaning means having a plate-like member with an opened central portion.

* * * * *

UNITED STATES PATENT AND TRADEMARK OFFICE

CERTIFICATE OF CORRECTION

PATENT NO. : 5,124,752

DATED : June 23, 1992

INVENTOR(S) : Makoto Kanno et al.

It is certified that error appears in the above-identified patent and that said Letters Patent is hereby corrected as shown below:

Title page, Title, change "DEVELOPING APPARATUS" to --DEVELOPING APPARATUS WITH IMPROVED TONER DISTRIBUTION--.

Title page, Inventors, change "Yoshio Shinna" to --Yoshio Shiina--.

Signed and Sealed this

Twenty-eighth Day of September, 1993

Bruce Lehman

*Attest:*

BRUCE LEHMAN

*Attesting Officer*

*Commissioner of Patents and Trademarks*